US006943781B1

(12) United States Patent
Lin et al.

(10) Patent No.: US 6,943,781 B1
(45) **Date of Patent: *Sep. 13, 2005**

(54) LIQUID CRYSTAL DISPLAY MODULE AND ITS SCANNING CIRCUIT BOARD

(75) Inventors: Tien-Jen Lin, Hsinchu (TW); Biing-Seng Wu, Yung-Kang (TW)

(73) Assignee: Chi Mei Optoelectronics Corporation, Tainan (TW)

( * ) Notice: Subject to any disclaimer, the term of this patent is extended or adjusted under 35 U.S.C. 154(b) by 304 days.

This patent is subject to a terminal disclaimer.

(21) Appl. No.: 09/609,651

(22) Filed: Jul. 3, 2000

(30) Foreign Application Priority Data

Dec. 1, 1999 (TW) ..... 88120974 A

(51) Int. Cl.[7] ..... G09G 5/00
(52) U.S. Cl. ..... 345/204; 345/87; 345/98
(58) Field of Search ..... 345/87, 98, 100, 345/204, 92, 205, 206

(56) References Cited

U.S. PATENT DOCUMENTS 4,922,240 A * 5/1990 Duwaer ..... 340/784
5,168,270 A * 12/1992 Masumori et al. ..... 340/784
5,365,284 A * 11/1994 Matsumoto et al. ..... 348/793
5,777,610 A * 7/1998 Sugimoto et al. ..... 345/206
5,781,171 A * 7/1998 Kihara et al. ..... 345/93
5,850,216 A * 12/1998 Kwon ..... 345/204
6,023,260 A * 2/2000 Higashi ..... 345/100
6,121,950 A * 9/2000 Zavracky et al. ..... 345/101
6,232,949 B1 * 5/2001 Imamura ..... 345/100
6,246,385 B1 * 6/2001 Kinoshita et al. ..... 345/87
6,266,041 B1 * 7/2001 Cairns et al. ..... 345/100
6,437,767 B1 * 8/2002 Cairns et al. ..... 345/100

* cited by examiner

*Primary Examiner*—Regina Liang
*Assistant Examiner*—Jennifer T. Nguyen
(74) *Attorney, Agent, or Firm*—Intellectual Property Solutions, Incorporated

(57) ABSTRACT

A liquid crystal display module and its scanning circuit board therein. There are a first scanning circuit and a second scanning circuit located at both ends of each of the scanning lines in the LCD panel. While scanning, both the first scanning circuit and the second scanning circuit drive the same scanning line simultaneously, so as to equivalently reduce the delay effect caused by the RC time constant. The first scan driving circuit and the second scan driving circuit could be placed on different scanning circuit boards with the same layout. The scanning circuit board has two connectors at the both ends and a scanning interface at a side. The scanning circuit board could be used at both sides of the LCD panel by the rotation of 180°.

15 Claims, 5 Drawing Sheets

LIQUID CRYSTAL DISPLAY MODULE AND ITS SCANNING CIRCUIT BOARD

BACKGROUND OF THE INVENTION

1. Field of the Invention

The present invention relates to a scanning technique of a LCD (liquid crystal display) panel. More particularly, this invention relates to a LCD module with symmetrical scanning circuit boards at the two ends of the LCD panel.

2. Description of the Prior Art

FIG. 1 (Prior Art) is a plane view of a conventional LCD module. As shown in FIG. 1, the LCD module comprises a LCD panel 100, a data circuit board 120, a plurality of data driver integrated circuits (ICs) 122, a scanning circuit board 130, a plurality of scan driver ICs 132, and a driving circuit 110. Driving circuit 110 connects to data circuit board 120 via connecting line 112 for transferring corresponding data driving signals and scanning control signals. Data circuit board 120 then connects to scanning circuit board 130 through connector 125 for transferring scanning control signals to scanning circuit board 130. Data driver IC 122 and scan driver IC 132 are in the form of the tape carrier package (or called TCP). Data driver ICs 122 connect to data circuit board 120 at the upper part of LCD panel 100, and scan driver ICs 132 connect to scanning circuit board 130 at the left side of LCD panel 100. The display of the conventional LCD is achieved by using a back light source or other light sources, which would not be described here.

FIG. 2 (Prior Art) is a circuit diagram of the conventional LCD panel 100. Assume that the LCD panel is a color LCD. As shown in FIG. 2, the LCD panel comprises a pixel electrode 101 with an array of m rows and 3*n* columns. The number of the pixel electrodes 101 is m×3*n*. Additionally, each pixel electrode 101 is configured at the intersection of the scanning lines (represented as 102(1)~102(*m*)) and the data lines (represented as 103(1)~103(*n*)), and the scanning lines are controlled with scan driver ICs 132, and the data lines are controlled with data driving ICs 122.

In a color LCD, each pixel comprises three pixel electrodes 101 representing red, green and blue, respectively. Namely, a group of m×n pixel electrodes 101 is used to represent red and forms the R subpixels. Another group of m×n pixel electrodes 101 is used to represent green and forms the G subpixels. Finally, the rest of the m×n pixel electrodes 101 is used to represent blue and forms the B subpixel. As a result, the color LCD has a total pixel or point number of m×3*n*.

The first to the m-th scanning lines or electrodes 102(1) to 102(*m*) are respectively aligned along the rows of the array. The first to the 3*n*-th data lines or electrodes 103(1) to 103(3*n*) are respectively aligned along the columns of the array. Thus, thin film transistors (TFTs) 106 with a total number of (m×3*n*) are configured at the intersections of scanning lines from 102(1) to 102(*m*) and data lines from 103 (1) to 103 (3*n*), in order to drive each of m×3*n* pixel electrodes 101.

Each TFT 106 on the same scanning line with its gate electrically links to the corresponding one of the scanning lines from 102(1) to 102(*m*). And each TFT 106 on the same data line with its drain electrically links to the corresponding one of the data lines from 103(1) to 103(*n*). The sources of all TFTs 106 electrically link to the corresponding pixel electrode 101.

According to FIG. 1 and FIG. 2, the operation of the conventional LCD module is described below. First of all, according to the current image data, driving circuit 110 sends the data driving signal to data circuit board 120 and sends the scanning control signal to scanning circuit board 130. According to the scanning control signal, scan driver IC 132 is able to scan every scanning line from 102(1) to 102(*m*) on the LCD panel. That is, scan driver IC 132 sends a logic high level signal to one of the scanning lines to turn on the TFTs 106 connected to this scanning line. On the other hand, data driver IC 122 sends the image data to the data lines from 103(1) to 103(3*n*). Meanwhile, all TFTs 106 connected to the scanning line pass the image data on the data lines to the correspondent pixel electrodes 101 for displaying. After all the scanning lines from 102(1) to 102(*m*) are scanned in sequence, the displaying of the whole picture frame is completed.

As described above, while processing the display of the pixels on a specified scanning line, scan driver IC 132 must send a logic high level signal to turn on all TFTs 106 on the scanning line. Accordingly, the image data on the data lines can be sent to the corresponding pixel electrodes 101. However, the case described above is ideal condition. In the real condition, since there is a delay effect caused by RC time constant of the conducting lines, the logic high level signal received by TFTs 106 connecting to the scanning line may undergo a severe distortion. FIG. 3 (Prior Art) is a schematic diagram of a conventional technique of a practical procedure for scanning the scanning lines. The logic high level pulse signal 133*a* sent from the scan driver IC 132 will turn on the nearest TFT 106 first. Nonetheless, when the logic high level pulse signal is transferred via the scanning line, the high frequency components are filtered out and a logic high level pulse signal 133*b* is produced due to the RC time constant of the resistance and the capacitance of the conducting line. The distorted logic high level pulse signal 133*b* could neither insure that the correspondent TFT 106 being provided with sufficient turn-on time to allow the image data to enter pixel electrode 101, nor that the closing time of the previous TFT being fast enough to avoid been overlapped by the next data line. The phenomenon is going to get worse in the LCD modules with larger sizes and higher resolutions. For example, in the LCD with the XGA type (with the size of about 13.3" to 14.1", and the resolution of 1024×768), the time for scanning each scanning line is about 20.67 $\mu$s. On the other hand, it will take 13.39 ms to scan each scanning line of the LCD with the UGXA type (with the size of 17", and the resolution of 1600×1200). Hence, when the size and resolution of a LCD get bigger, the delaying problem of the scanning line is getting more serious. This is the problem encountered when proceeding the driving of a conventional LCD module.

SUMMARY OF THE INVENTION

Therefore, the object of the present invention is to provide a LCD module with identical scanning circuit boards located at both sides of the LCD panel and the connected scan driver ICs would carry out the scanning of each scanning line from both ends, thereby equivalently reducing the delay effect of each scanning line caused by the RC time constant. Accordingly, the quality of the LCD module is improved.

The present invention achieves the above-indicated objects by providing a LCD module comprising a LCD panel, a driving circuit unit, a first scanning circuit board, a second scanning circuit board, a plurality of first scan driver IC and a plurality of second scan driver IC. The LCD panel has a plurality of scanning lines parallel to its width side. The driving circuit unit is applied to emit a first scanning control signal and a second scanning control signal which are then sent to the first scanning circuit board and the second scanning circuit board, respectively. The first scanning circuit board is configured at the first height side of the LCD panel. The second scanning circuit board is placed at the second height side of the LCD panel. In additioni, the first scanning circuit board and the second scanning circuit board have the same circuit layout, and both are provided with a first connector, a second connector and a scanning interface, respectively. The scanning circuit board receives the first scanning control signal via its first connector and sends it to its scanning interface. The second scanning circuit board receives the second scanning control signal via its second connector and sends it to its scanning interface. The first scan driver ICs are coupled between the scanning interface of the first scanning circuit board and a side of the LCD panel to scan the scanning lines sequentially according to the first scanning control signal. Meanwhile, the second scan driver ICs are coupled between the scanning interface of the second scanning circuit board and an opposite side of the LCD panel to scan the scanning lines sequentially according to the second scanning control signal. In addition, the first scan driver ICs and the second scan driver ICs drive the same scanning line synchronously, thereby equivalently reducing the delay effect resulted from the RC time constant.

In addition, in order to share the same circuit board assembly, the first scan driver ICs and the second scan driver ICs are configured in rotation of 180° to each other, and the scanning sequences are reverse in practice. The first scanning control signal sent to the first scanning circuit board contains a first data-shifting direction signal (that is the R/L signal) and a first scanning activation signal (that is, the STVR or STVL signal). In addition, the second scanning control signal sent to the second scanning circuit board contains a second data-shifting direction signal (that is, the R/L signal) and a second scanning activation signal (that is, the STVR or STVL signal). The first data-shifting direction signal and the second data-shifting direction signal respectively represent opposite shifting directions. The first scanning activation signal and the second scanning activation signal are respectively used for activating the scanning procedures of the first scan driver ICs and the second scan driver ICs.

Furthermore, the present invention provides a scanning circuit board located in a LCD module with a LCD panel, which comprises a first connector configured at one end of the scanning circuit board for receiving the first scanning control signal, a second connector configured at the other end of the scanning circuit board for receiving the second scanning control signal, and a scanning interface placed at the side of the scanning circuit board for connecting with the scan driver ICs. It is noticed that, in a certain configuration, each scanning circuit board only uses one of the both connectors. When the scanning circuit board is configured at the first height side of the LCD panel and receives the first scanning control signal through the first connector, the scan driver ICs on the scanning interface can scan every scanning line sequentially from the first height side of the LCD panel. In addition, when the scanning circuit board is placed at the second height side of the LCD panel and receives the second scanning control signal from the second connector, the scan driver ICs on the scanning interface can scan every scanning line sequentially from the second height side.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

The present invention is to provide a solution to the delay effect caused by RC time constant of the scanning lines in driving the LCD panel. The present invention can be applied to the LCD with bigger sizes and higher resolutions developed in the future. The embodiment of the present invention is to provide identical scan driver ICs at the both sides of the LCD panel respectively (namely the two ends of each scanning line) and to scan one of the scanning lines from the both ends at the same time, thereby equivalently reducing the equivalent RC time constant. Because the scanning operation is performed from both ends of each scanning line, the greatest delay would occur at the center of the picture frame.

Figure 4:
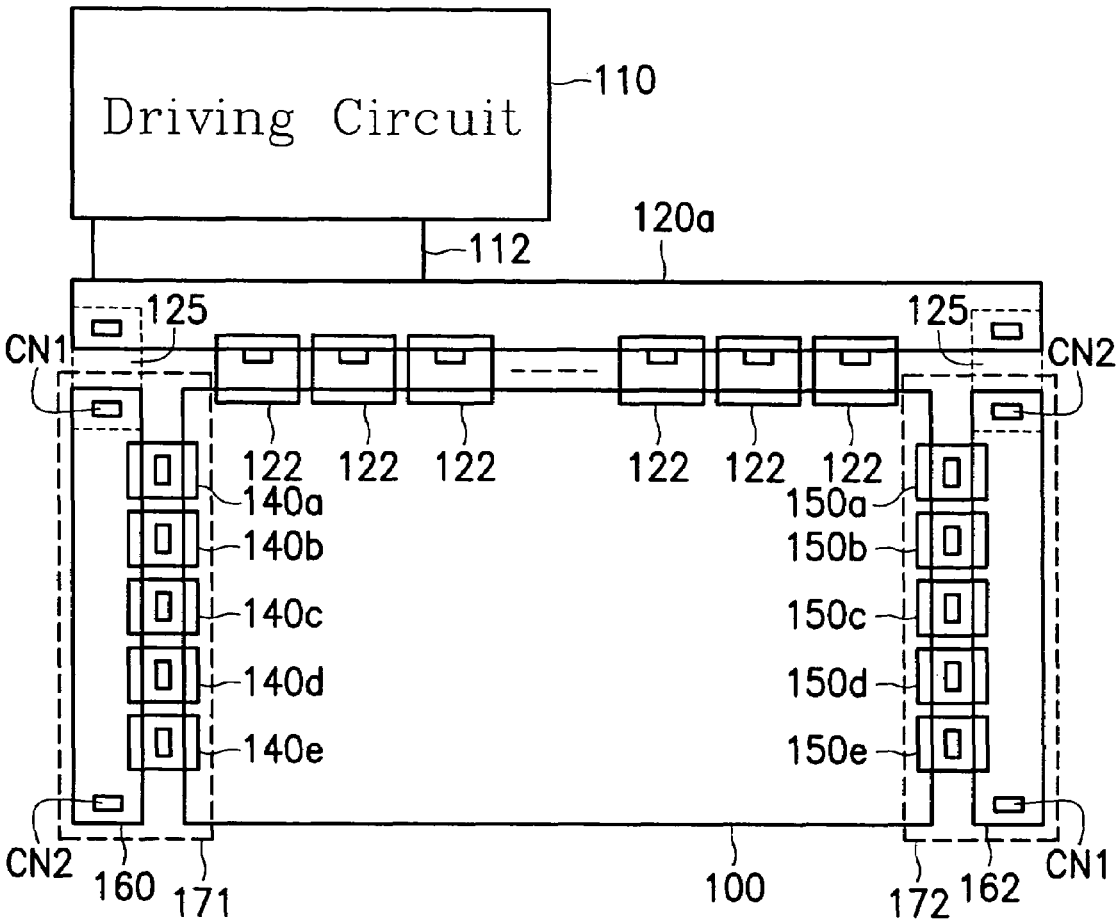
FIG. 4 is a plane view of the LCD module in accordance with the embodiment of the present invention.

To realize the scanning method described, the embodiment of the present invention uses identical scan driver ICs and scanning circuit boards to implement the driving mechanism at the both ends of the scanning lines, thereby reducing the number of the components required in the assembly line. FIG. 4 represents a plan view of a LCD module in accordance with this embodiment, wherein the components that are the same with those shown in FIG. 1 are marked by the same symbols.

As shown in FIG. 4, the LCD module primarily comprises a driving circuit 110, a data circuit board 120*a*, data driver ICs 122, a scan circuit board 160, scan driver ICs 14*a*~14*e*, a scan circuit board 162, scan driver ICs 150*a*~150*e* and a LCD panel 100. It is assumed that the LCD panel 100 of this embodiment has a resolution of 1600×1200. If each scan driver IC (140*a*~140*e* or 150*a*~150*e*) includes 240 scanning channels, the embodiment of the present invention would need 10 scan driver ICs. In addition, if each data driver IC includes 400 data channels, the embodiment of the present invention would need 1600×3/400=12 data driver ICs.

Figure 1:
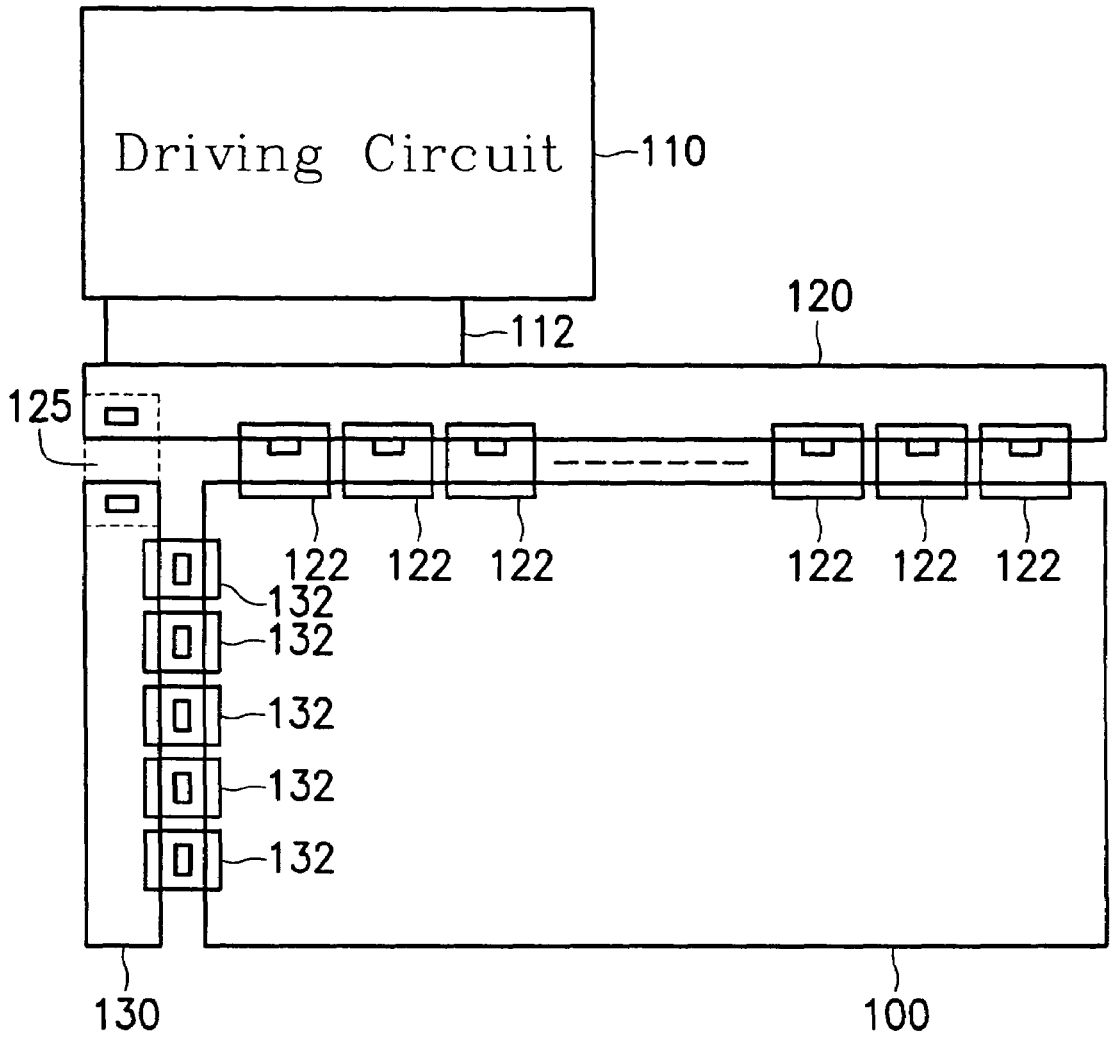
FIG. 1 (PRIOR ART)
FIG. 1 (Prior Art) is a plane view of a conventional LCD module.
Figure 2:
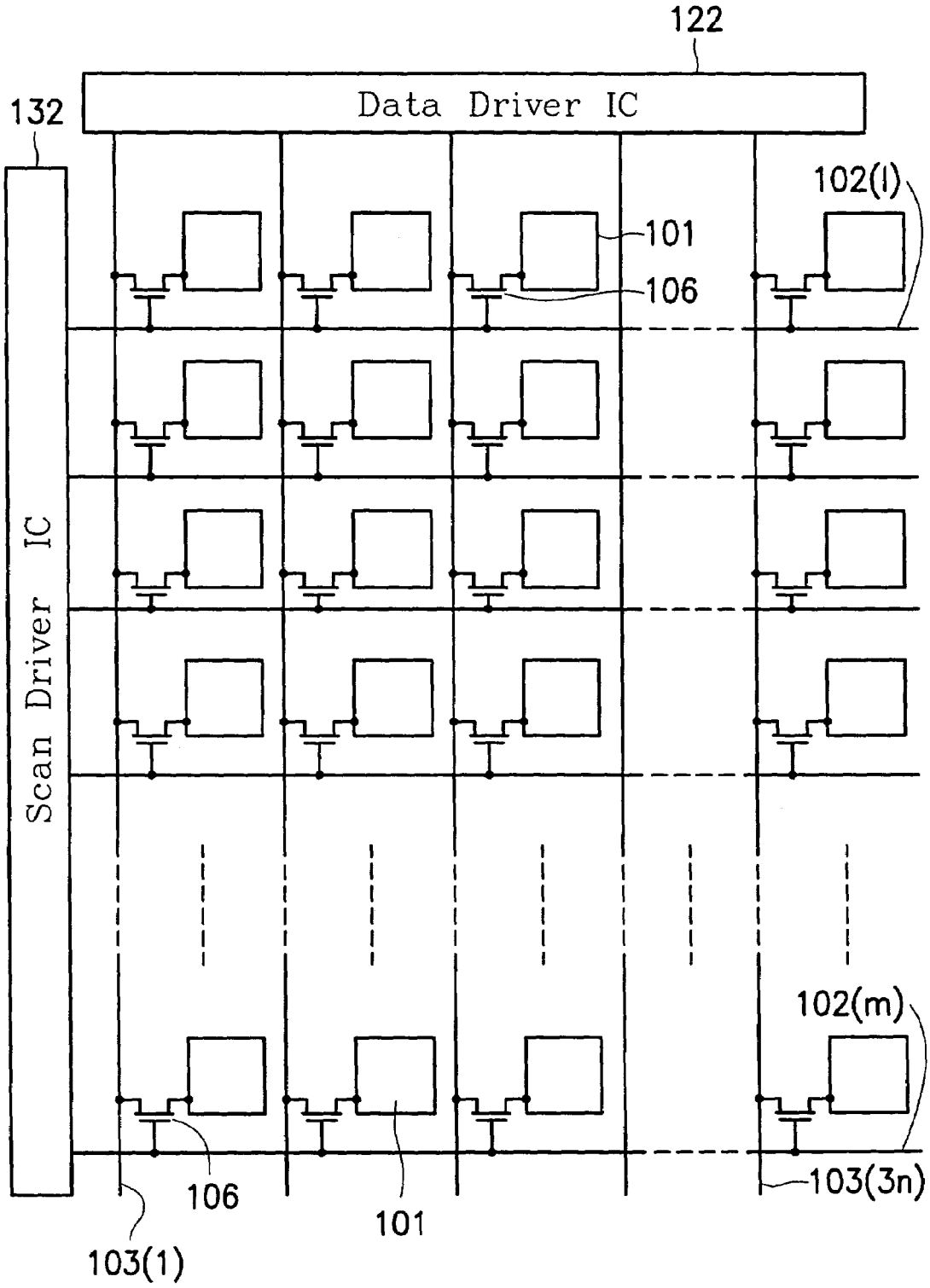
FIG. 2 (PRIOR ART)
FIG. 2 (Prior Art) is a circuit diagram of a conventional LCD panel.
Figure 3:
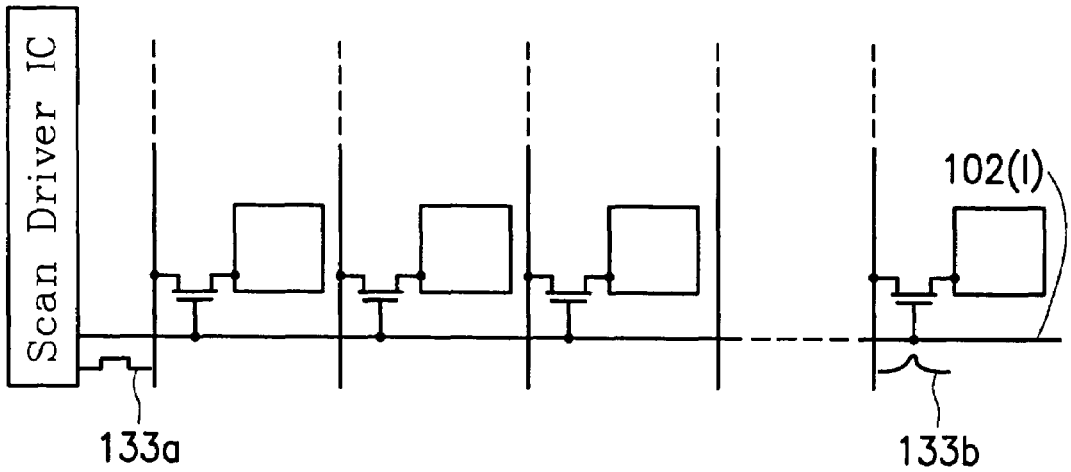
FIG. 3 (PRIOR ART)
FIG. 3 (Prior Art) is a schematic diagram for illustrating the scenning process in the prior art.

The differences between the present invention and the conventional technique shown in FIG. 1 are described as follows:

(1) At the both opposite sides of LCD panel 100, there are a scanning unit 170 including the scanning circuit board 160 and the scan driver ICs 140*a*~140*e*, and a scanning unit 172 including the scanning circuit board 162 and the scan driver ICs 150*a*~150*e*. In practice, scanning unit 170 and 172 synchronously scan every scanning line in LCD panel 100. It is noticed that since scanning circuit board 160 and scanning circuit board 162 have the same circuit layout, there is only one kind of the circuit board needed for preparation in the assembly line. In addition, scan driver circuit IC 140*a*~140*e* and scan driver IC 150*a*~150*e* can be implemented by the same commercial scan driver ICs. Namely, there is only one kind of the scan driver IC needed for preparation in the assembly line.

(2) The driving circuit 110 would send the correspondent signals to scanning unit 170 and 172 respectively via connector 125 so as to adapt to different scanning conditions at the both sides. Essentially, the first scanning control signal and the second scanning control signal contains the same signal lines, which are slightly different in some aspects and will be described later.

The two features described above are further discussed in the following.

Figure 5:
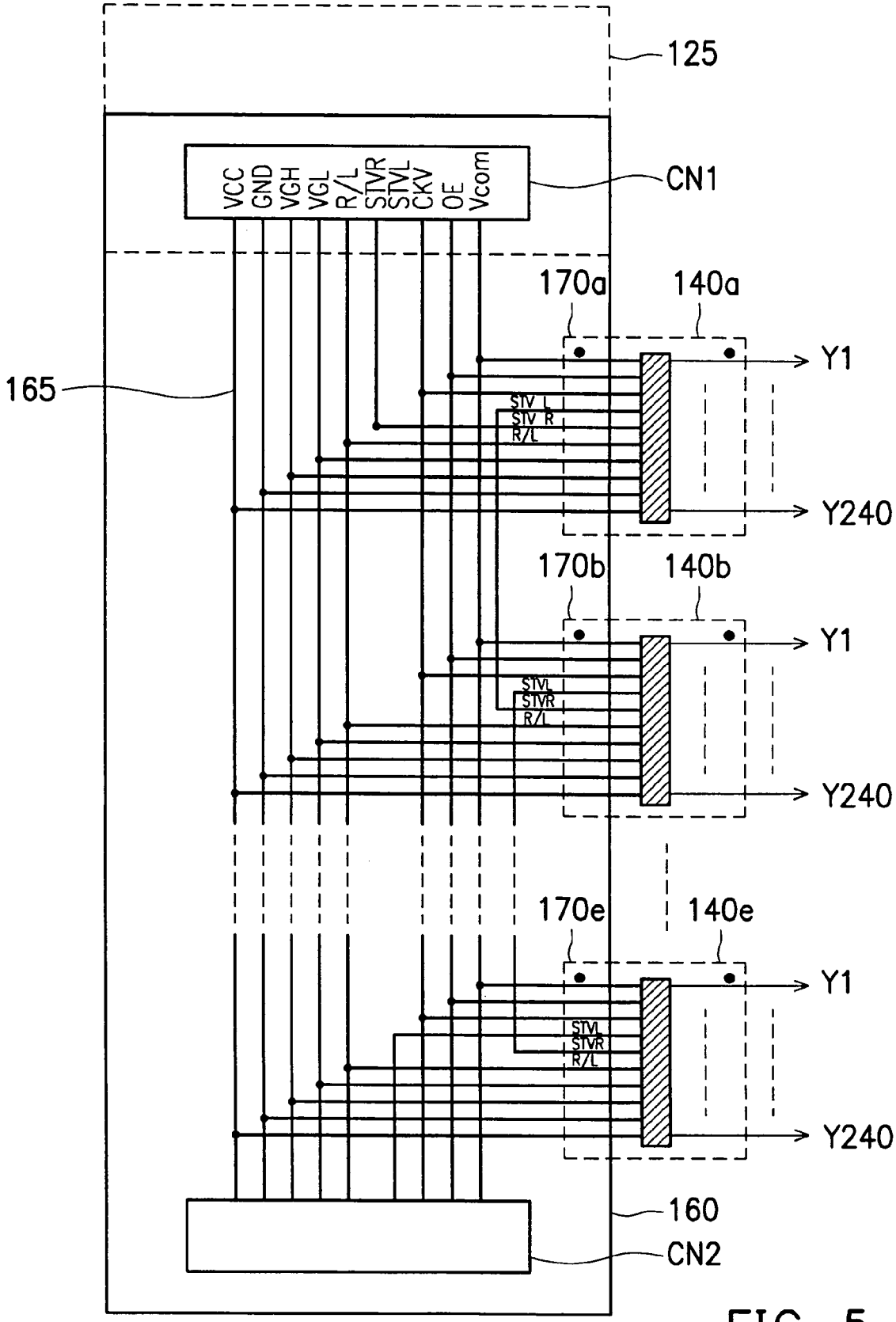
FIG. 5 is a schematic diagram of the scanning circuit board configured at the left side of the LCD panel in accordance with the embodiment of the present invention.

As described above, the first scanning circuit board 160 and the second scanning circuit board 162 are the same, namely the two circuit boards have the same circuit layout. FIG. 5 is a schematic plan diagram of the scanning circuit board 160 in accordance with the embodiment of present invention. The scanning circuit board 160 comprises a connector CN1, a connector CN2, scanning interface circuits 170*a*~170*e* and a on-board circuit 165.

Connector CN1 or CN2 is selectively connected to an external connector 125 for receiving the correspondent scanning control signal. It is noticed that only one of the both connectors is in use at a time. As shown in FIG. 5, only connector CN1 is connected to connector 125. Scanning interface circuits 170*a*~170*e*, meanwhile, are configured to the right side of scanning circuit board 160 for connecting with the five scan driver ICs 140*a*~140*e*. On-board circuit 165 is applied for sending the scanning control signals received from connector CN1 or connector CN2 to scanning interface circuits 170*a*~170*e*. In FIG. 5, since only connector CN1 is in use, the portion of on-board circuit 165 pertaining to connector CN2 is regarded as the open circuit.

On the scanning circuit board 160 shown in FIG. 5, the scan driver ICs 140*a*~140*e* are sequentially mounted and connected with scanning interface circuits 170*a*~170*e* in a normal or increment direction. The input/output terminals of each scan driver IC comprises a control input terminal (connected to the side of the circuit board) and scanning output terminals (connected to the side of the LCD panel). Symbol "•"shown in the figure represents the location of the first pin. More specifically, all the scanning control signal lines (described later) sent to the scan driver ICs 140*a*~140*e* are configured in the downward order, and the pins pertaining to the scan driving signals (represented as Y1~Y240) are also configure in the normal order. Scanning circuit board 160 is placed at the left side of LCD panel 100.

Figure 6:
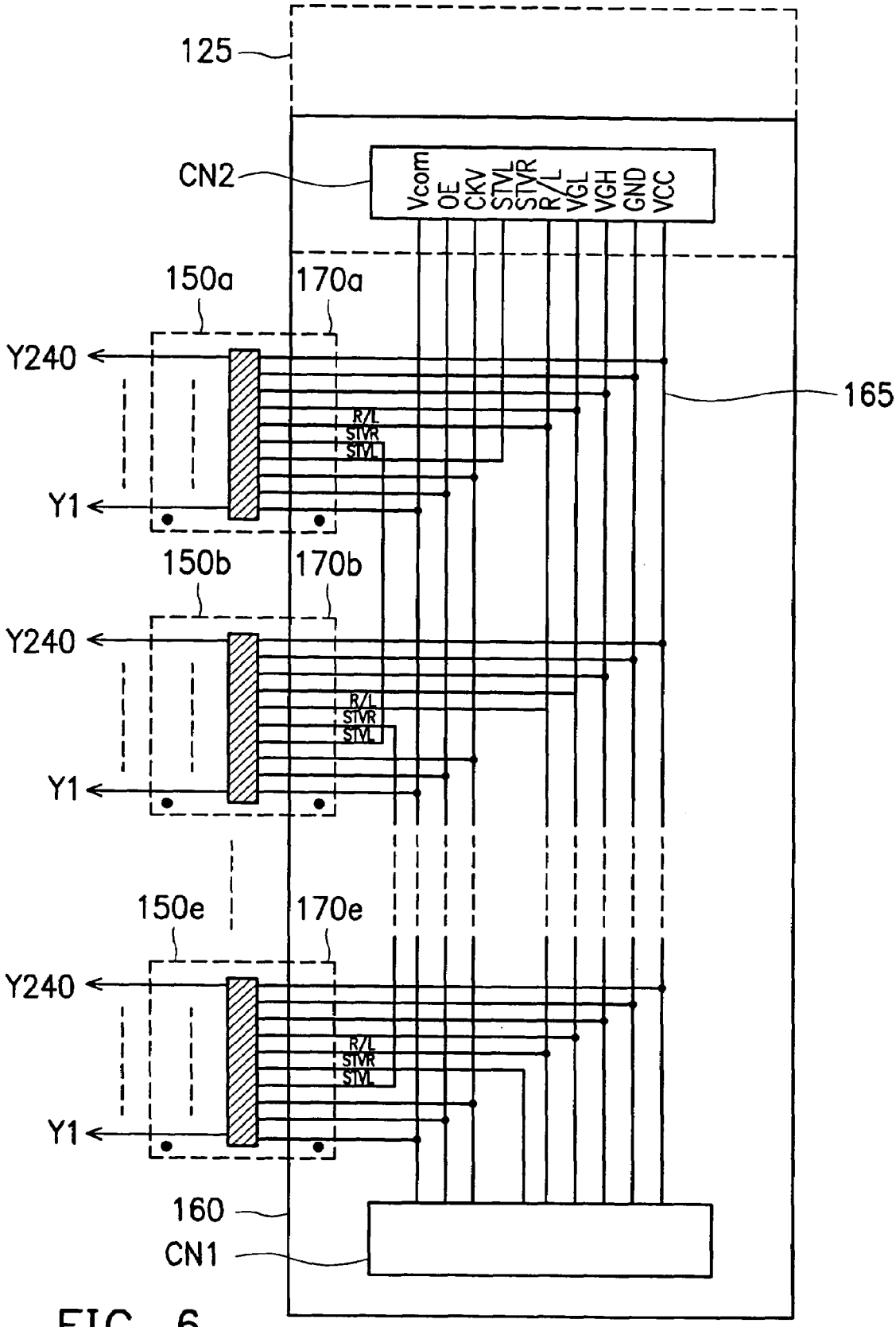
FIG. 6 is a schematic diagram of the scanning circuit board configured at the right side of the LCD in accordance with the embodiment of the present invention.

On the other hand, FIG. 6 represents a schematic diagram of scanning circuit board 162 in accordance with the embodiment of the present invention. In other words, the same circuit board component in the assembly line is placed at the right side of LCD panel 100. As shown in FIG. 6, the scanning circuit board 162 has the same structure as the scanning circuit board 160, including a connector CN1, a connector CN2, scanning interface circuits 170*a*~170*e* and a on-board circuit 165. Practically, scanning circuit board 162 can be obtained by rotating the scanning circuit board 160 shown in FIG. 5 by 180°. In this case, only connector CN2 is connected to connecting unit 125 and connector CN1 is not in use. In addition, scanning interface circuits 170*e*~170*a* (in the reverse order) are now located at the left side of scanning circuit board 162 for connecting the five scan driver ICs 150*a*~150*e*.

In the scanning circuit board 162 shown in FIG. 6, each scan driver IC 150*a*~150*e* configured to scanning interface 170*a*~170*e* is in the reverse order. Namely, all the scanning control lines sent to each scan driver IC 150*a*~150*e* are configured upwardly, and the pins pertaining to scan driving signals (represented as Y1~Y240) are also configured in the reverse order. Meanwhile, scanning circuit board 162 is placed at the right side of LCD panel 100.

The on-board circuit 165 is used to guide the scan driving signals received from connector CN1 and connector CN2 to the coresponding pins of scanning interface circuits 170*a*~170*e* for the two different situations. Each pin of scanning interface circuits 170*a*~170*e* is connected to two input sources, one from connector CN1 and the other from connector CN2. Since only one connector is used at a time, each pin of scanning interface circuits 170*a*~170*e* hence receives a signal from one input source only, and the other input source is regarded as open. Hence one circuit board component in the assembly line can be used to implement scanning circuit board 160 and scanning circuit board 162. In the preferred embodiment of the present invention, since the circuit board component can be used to implement the scanning circuit board 160 and the scanning circuit board 162, the number of the components prepared in the assembly line will not increase, which facilitates the material management in the production line.

In the embodiment of the present invention, each of the first scanning control signal and the second scanning control signal generated by driving circuit 110 comprises the following signal lines: (1) VCC (power source); (2) GND (ground); (3) VGH (the high level of the scanning signal); (4) VGL (the low level of the scanning signal); (5) R/L (representing the data shifting direction to be right, denoted by "R", or left, denoted by "L"); (6) STVR (forward scanning signal); (7) STVL (backward scanning signal); (8) CKV (vertical clock pulse); (9) OE (output enabling signal); and (10) VCOM (common electrode voltage). Referring to FIG. 5 and FIG. 6, the ten signal lines are allocated in the numbering order from the starting position "•." It is noticed that scan driver ICs 140*a*~140*e* and scan driver ICs 150*a*~150*e* are allocated in the reverse directions.

The first scanning control signal sent to scanning circuit 160 and the second scanning control signal sent to scanning circuit board 162 are different in the signal line R/L, the signal line STVR and the signal line STVL. The signal line R/L contained in the first scanning control signal is set as "R", which means the shifting direction is set as right, and the signal line R/L contains in the second scanning control signal is set as "L", which means the shifting direction is set as left. They are set to be the reverse directions. These signals could be implemented by using an inverter. In addition, since scan driver ICs 140*a*~140*e* connected to sccanning circuit board 160 are in a normal scanning sequence (from Y1 to Y240), the signal line STVR is set and the signal line STVL is floating. On the other hand, since scan driver ICs 150*a*~150*e* connected to scanning circuit board 162 are in the reverse scanning sequence, the signal line STVL is set and the signal line STVR is floating. The signal assignment can be implemented by the exchange of the signal lines.

It is noticed that, between scan driver ICs 140*a*~140*e* or scan driver ICs 150*a*~150*e*, a designating signal is needed to notify the next scan driver IC that the last scan driver IC finishes the scanning of its corresponding scanning lines, in order to continue the scanning procedure. As shown in FIG. 5, the pin of scan driver IC 140*a* denoted by STVR receives the signal line STVR of the first scanning control signal, and the scan driver IC 140*a* sequentially drives the scanning lines from Y1 to Y240. After the driving of the 240 scanning lines is completed, the pin of scan driver IC 140*a* denoted by STVL sends a notification signal to the pin of the scan driver IC 140*b* denoted by STVR for activating the scanning performed by the scan driver IC 140*b*. The transference of the notification signal continues until reaching the scan driver IC 140*e*. At this time, the scanning procedure for all the scanning lines is completed. On the other hand, as shown in FIG. 6, the pin of the scan driver IC 150*a* denoted by STVL receives the signal line STVL of the second scanning control signal, and the scan driver IC 150*a* sequentially drives the scanning lines from Y240 to Y1. After the driving of the 240 scanning lines is completed, the pin of scan driver IC 150*a* denoted by STVR sends a notification signal to the pin of the scan driver IC 150*b* denoted by STVL for activating the scanning performed by the scan driver IC 150*b*. The transference of the notification signal continues until reaching the scan driver IC 150*e*. At this time, the scanning procedure for all the scanning lines is completed.

Accordingly, each scanning line of LCD panel 100 is drived from its both ends synchronously in order to equivalently reduce the delay effect caused by the RC time constant. In addition, since the driving circuit boards and the scan driver ICs used at the both ends are the same (merely configured to the opposite direction), it will not increase the cost of the preparation for the assembly components and thus suitable for industrial use.

While the preferred embodiment of the present invention has been described using specific terms, the description has been illustrative purpose only, and it is to be understood that changes may be made without departing to the spirit or scope of the following claim.

What is claimed is:

1. A liquid crystal display module, comprising:

a liquid crystal display panel having a plurality of scanning lines parallel to a first side of the liquid crystal display panel;

a driving circuit unit for generating a first scanning control signal and a second scanning control signal;

a first scanning unit, comprising:

a first scanning circuit board, coupled to the driving circuit unit, for receiving the first scanning control signal; and a plurality of first scan drivers, coupled between the first scanning circuit board and a second side of the liquid crystal display panel, for sequentially scanning the scanning lines according to the first scanning control signal; and a second scanning unit, comprising:

a second scanning circuit board, coupled to the driving circuit unit, for receiving the second scanning control signal; and a plurality of second scan drivers, coupled to the second scanning circuit board and a third side of the liquid crystal display panel opposite to the second side of the liquid crystal panel, for sequentially scanning the scanning lines according to the second scanning control signal;

wherein the first scanning unit and the second scanning unit drive one of the scanning lines simultaneously;

the first scanning circuit board is the same as the second scanning circuit board; each scanning circuit board has a first connection port, a second connection port and a third connection port, the first scan drivers receive the first scanning control signal through the first and second connection ports, not through the third connection port, the second scan drivers receive the second scanning control signal through the second and third connection ports, not through the first connection port, and the scanning of the first scan drivers and the scanning of the second scan drivers are in reverse order.

2. The liquid crystal display module as claimed in claim 1, wherein the first and the third connection ports are connectors, and the second connection port is scanning interface.

3. The liquid crystal display module as recited in claim 1, wherein the first scan drivers and the second scan drivers are integrated circuits with tape carrier packages.

4. The liquid crystal display module as recited in claim 1, wherein the first scanning control signal contains a first data-shifting direction signal and a first scanning activation signal, and the second scanning control signal contains a second data-shifting direction signal and a second scanning activation signal.

5. The liquid crystal display module as recited in claim 4, wherein the first data-shifting direction signal of the first scanning control signal and the second data-shifting direction signal of the second scanning control signal represent the reverse shifting directions; and the first scanning activation signal of the first scanning control signal and the second scanning activation signal of the second scanning control signal respectively activate the scanning procedures of the first scan drivers and the second scan drivers.

6. The liquid crystal display module as recited in claim 1, wherein both the first and second scanning circuit board for connecting with a plurality of scan drivers to scan a plurality of scanning lines extending from one side of the liquid crystal display panel to another side of the liquid crystal display panel, each comprises:

the first connector, located at a first end of the scanning circuit board;

the second connector, located at a second end of the scanning circuit board;

the scanning interface for connecting with the scan drivers; and an on-board circuit for sending the scanning control signals received from the first connector or the second connector to the scanning interface, wherein the scan drivers connected to the scanning interface sequentially scan the scanning lines from the second side of the liquid crystal display panel when the scanning circuit board is allocated to the second side of the liquid crystal display panel and receives a first scanning control signal via the first connector, and the scan drivers connected to the scanning interface sequentially scan the scanning lines from the third side of the liquid crystal display panel when the scanning circuit board is allocated to the third side of the liquid crystal display panel and receives a second scanning control signal via the second connector.

7. The liquid crystal display module as recited in claim 6, wherein the first scanning control signal contains a first data-shifting direction signal and a first scanning activation signal, and the second scanning control signal contains a second data-shifting direction signal and a second scanning activation signal.

8. The liquid crystal display module as recited in claim 7, wherein the first data shifting direction signal of the first scanning control signal and the second data shifting direction signal of the second scanning control signal respectively represent the reverse shifting directions; and the first scanning activation signal of the first scanning control signal and the second scanning activation signal of the second scanning control signal respectively activate the scanning procedures of the first scan drivers and the second scan drivers.

9. A liquid crystal display module, comprising:

a liquid crystal display panel having a plurality of scanning lines parallel to a first side of the liquid crystal display panel;

a driving circuit unit for generating a first scanning control signal and a second scanning control signal;

a first scanning unit, comprising:

a first scanning circuit board, coupled to the driving circuit unit, for receiving the first scanning control signal; and a plurality of first scan drivers, coupled between the first scanning circuit board and a second side of the liquid crystal display panel, for sequentially scanning the scanning lines according to the first scanning control signal; and a second scanning unit, comprising:

a second scanning circuit board, coupled to the driving circuit unit, for receiving the second scanning control signal; and a plurality of second scan drivers, coupled to the second scanning circuit board and a third side of the liquid crystal display panel opposite to the second side of the liquid crystal panel, for sequentially scanning the scanning lines according to the second scanning control signal;

wherein the first scanning unit and the second scanning unit drive one of the scanning lines simultaneously;

the first scanning circuit board is the same as the second scanning circuit board; each scanning circuit board has a first connector, a second connector and a scanning interface, the first scan drivers receive the first scanning control signal through the first connector and the scanning interface, not through the second connector, the second scan drivers receive the second scanning control signal through the second connector and the scanning interface, not through the first connector, and the scanning of the first scan drivers and the scanning of the second scan drivers are in reverse order.

10. The liquid crystal display module as recited in claim 9, wherein the first scan drivers and the second scan drivers are integrated circuits with tape carrier packages.

11. The liquid crystal display module as recited in claim 9, wherein the first scanning control signal contains a first data-shifting direction signal and a first scanning activation signal, and the second scanning control signal contains a second data-shifting direction signal and a second scanning activation signal.

12. The liquid crystal display module as recited in claim 11, wherein the first data-shifting direction signal of the first scanning control signal and the second data-shifting direction signal of the second scanning control signal represent the reverse shifting directions;

and the first scanning activation signal of the first scanning control signal and the second scanning activation signal of the second scanning control signal respectively activate the scanning procedures of the first scan drivers and the second scan drivers.

13. The liquid crystal display module as recited in claim 9, wherein both the first and second scanning circuit board, respectively configured at a the liquid crystal display module with a the liquid crystal display panel, for connecting with a plurality of scan drivers to scan a plurality of scanning lines extending from one side of the liquid crystal display panel to a another side of the liquid crystal display panel, each comprises:

a the first connector, located at a first end of the scanning circuit board;

a the second connector, located at a second end of the scanning circuit board;

a the scanning interface for connecting with the scan drivers; and an on-board circuit for sending the scanning control signals received from the first connector or the second connector to the scanning interface, wherein the scan drivers connected to the scanning interface sequentially scan the scanning lines from the second side of the liquid crystal display panel when the scanning circuit board is allocated to the second side of the liquid crystal display panel and receives the first scanning control signal via the first connector, and the scan drivers connected to the scanning interface sequentially scan the scanning lines from the third side of the liquid crystal display panel when the scanning circuit board is allocated to the third side of the liquid crystal display panel and receives the second scanning control signal via the second connector.

14. The liquid crystal display module as recited in claim 13, wherein the said first scanning control signal contains a first data-shifting direction signal and a first scanning activation signal, and the second scanning control signal contains a second data-shifting direction signal and a second scanning activation signal.

15. The liquid crystal display module as recited in claim 14, wherein the first data shifting direction signal of the first scanning control signal and the second data shifting direction signal of the second scanning control signal respectively represent the reverse shifting directions; and the first scanning activation signal of the first scanning control signal and the second scanning activation signal of the second scanning control signal respectively activate the scanning procedures of the first scan drivers and the second scan drivers.

* * * * *